US008441312B2

(12) United States Patent
Yuasa

(10) Patent No.: US 8,441,312 B2
(45) Date of Patent: May 14, 2013

(54) REFERENCE CURRENT GENERATING CIRCUIT

(75) Inventor: Tachio Yuasa, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 139 days.

(21) Appl. No.: 13/044,316

(22) Filed: Mar. 9, 2011

(65) Prior Publication Data

US 2011/0221517 A1 Sep. 15, 2011

(30) Foreign Application Priority Data

Mar. 11, 2010 (JP) ..... 2010-054211

(51) Int. Cl.
*G05F 1/10* (2006.01)

(52) U.S. Cl.
USPC ..... 327/543

(58) Field of Classification Search ..... 327/534, 327/535, 537, 538, 543
See application file for complete search history.

(56) References Cited

U.S. PATENT DOCUMENTS 5,481,179 A * 1/1996 Keeth ..... 323/315
6,107,868 A * 8/2000 Diniz et al. ..... 327/543
6,600,361 B2 * 7/2003 Nagaya et al. ..... 327/538
6,737,909 B2 * 5/2004 Jaussi et al. ..... 327/541
7,057,448 B2 * 6/2006 Tanigawa et al. ..... 327/543
7,064,601 B2 * 6/2006 Kwak et al. ..... 327/541
7,342,439 B2 * 3/2008 Hsiao ..... 327/538
7,573,325 B2 * 8/2009 Garcia ..... 327/543
8,188,785 B2 * 5/2012 Iacob et al. ..... 327/543

FOREIGN PATENT DOCUMENTS

JP 2001-142552 A 5/2001

* cited by examiner

*Primary Examiner* — Jeffrey Zweizig
(74) *Attorney, Agent, or Firm* — Foley & Lardner LLP

(57) ABSTRACT

A reference current generating circuit has: first and second current mirror circuits and first and second output terminals. The first current mirror circuit has: a first transistor of a first polarity being an input-side transistor; and a first resistor connected between a gate of the first transistor and a power supply terminal. The second current mirror circuit has a second transistor of a second polarity being an input-side transistor. An output node of the first current mirror circuit is connected to an input node of the second current mirror circuit, and an input node of the first current mirror circuit is connected to an output node of the second current mirror circuit. A control voltage applied to the gate of the first transistor is output from the first output terminal. A control voltage applied to a gate of the second transistor is output from the second output terminal.

9 Claims, 4 Drawing Sheets

REFERENCE CURRENT GENERATING CIRCUIT

INCORPORATION BY REFERENCE

This application is based upon and claims the benefit of priority from Japanese patent application No. 2010-054211, filed on Mar. 11, 2010, the disclosure of which is incorporated herein in its entirety by reference.

BACKGROUND OF THE INVENTION

1. Field of the Invention

The present invention relates to an electronic circuit for treating an analog signal. In particular, the present invention relates to a reference current generating circuit that generates a stable reference current.

2. Description of Related Art

A reference current generated by a reference current generating circuit is supplied to another electronic circuit such as an operational amplifier and used as an operating point current that is a basis of a circuit operation. It is desirable that an operation and characteristics of the electronic circuit to which the reference current is supplied are stable with respect to variable factors such as a junction temperature. This requires the reference current generated by the reference current generating circuit to be also stable with respect to variable factors such as the junction temperature.

A reference current generating circuit is disclosed, for example, in Japanese Patent Publication JP-2001-142552. FIG. 1 shows a configuration of the reference current generating circuit X1. The reference current generating circuit X1 is provided with: N-channel MOS transistors M11 to M12, M16 to M17; P-channel MOS transistors M13 to M15; resistors R11 to R13; a PN junction diode D11; an output node CM1; and power supply terminals VDD and GND. All the MOS transistors are enhancement (normally off) type. Although description of a connection to a back gate of the MOS transistor is omitted in FIG. 1, the back gate may be connected to a source of the MOS transistor. Alternatively, a back gate of the N-channel MOS transistor may be connected to the power supply terminal GND, and a back gate of the P-channel MOS transistor may be connected to the power supply terminal VDD.

An operation of the reference current generating circuit X1 will be described below. In the reference current generating circuit X1, the N-channel MOS transistors M11 and M12 constitute a Widlar current mirror circuit. The P-channel MOS transistors M13 to M15 constitute a typical linear current mirror circuit whose input side is the transistor M14. The N-channel MOS transistors M16 and M17 also constitute a typical linear current mirror circuit whose input side is the transistor M16. The Widlar current mirror circuit has nonlinearity characteristics. An input and an output of the Widlar current mirror circuit are connected to the linear current mirror circuit, and the circuits as a whole constitutes a self-feedback circuit. A current flowing in the circuits as a whole is stabilized and converged to either zero or a specific value that is determined by respective circuit constants of the both current mirror circuits with which respective input/output current values match with each other.

Let us calculate the non-zero specific current values I1 to I4. Let Wx and Lx respectively denote a gate width and a gate length of a MOS transistor Mx (x is an element number). For simplifying of circuit analysis, characteristics such as electron mobility, hole mobility and a gate capacitance per unit area are the same between MOS transistors of the same polarity among the transistors M11 to M17. In the transistor Mx, let I0$x$ denote a drain current in a case where a gate-source voltage is equal to a threshold voltage, and let Vt denote a thermal voltage (Vt=k×T/q: k is the Boltzmann constant, T is an absolute temperature, and q is unit charge). According to Japanese Patent Publication JP-2001-142552, the N-channel MOS transistors M11 and M12 operate in a sub-threshold region. Therefore, when a drain current and a gate-source voltage of the transistor M11 are expressed by I1 and V1, respectively, and a drain current and a gate-source voltage of the transistor M12 are expressed by I2 and V2, respectively, the following equations (1) to (3) can be obtained.

$$I1 = I011 \cdot \frac{W11}{L11} \cdot \exp\left(\frac{V1}{Vt}\right) \tag{1}$$

$$I2 = I012 \cdot \frac{W12}{L12} \cdot \exp\left(\frac{V2}{Vt}\right) \tag{2}$$

$$V1 = V2 + I2 \cdot R11 \tag{3}$$

By substituting the equations (1) and (2) into the equation (3), we obtain the following equation (4).

$$I2 = \frac{1}{R11} \cdot (V1 - V2) = \frac{1}{R11} \cdot \left\{ Vt \cdot \ln\left(\frac{I1}{I011 \cdot \frac{W11}{L11}}\right) - Vt \cdot \ln\left(\frac{I2}{I012 \cdot \frac{W12}{L12}}\right) \right\} \tag{4}$$

$$\therefore I2 = \frac{Vt}{R11} \ln\left(\frac{I1 \cdot I012 \cdot \frac{W12}{L12}}{I2 \cdot I011 \cdot \frac{W11}{L11}}\right)$$

Furthermore, for simplifying of circuit analysis, let us consider a case where each of the transistors M13 to M17 operates in a saturation region, and influences by the body effect and the early effect are negligible. According to Japanese Patent Publication JP-2001-142552, W13/L13=W14/L14=W15/L15 and W16/L16=W17/L17. In this case, the following equations (5) and (6) can be obtained. Here, let VD11 denote a forward voltage of the PN junction diode D11.

$$I1=I2=I3=I4 \tag{5}$$

$$V3=VD11+I3\times R12=I4\times R13 \tag{6}$$

By substituting the equations (4) and (5) into the equation (6), we obtain the following equation (7).

$$I4 = \frac{1}{R13} \cdot (VD11 + I3 \cdot R12) \tag{7}$$

$$\therefore I4 = \frac{1}{R13} \cdot \left\{ VD11 + Vt \cdot \frac{R12}{R11} \cdot \ln\left(\frac{I012 \cdot \frac{W12}{L12}}{I011 \cdot \frac{W11}{L11}}\right) \right\}$$

Next, temperature dependence of the output current I4 in the case of the reference current generating circuit X1 is considered. For simplifying of circuit analysis, let us consider a case where resistance values of the resistors R11 to R13 have no temperature dependence. Since the N-channel MOS transistors M11 and M12 have the same characteristics, temperature characteristics of the respective drain currents I011 and I012 are the same, and therefore no temperature characteristic appears in a parameter "I012/I011". Thus, in the equation (7), only the forward voltage VD11 and thermal voltage Vt have temperature characteristics. By differentiate both sides of the equation (7) with respect to absolute temperature T, the following equation (8) can be obtained.

$$\therefore \frac{\partial I4}{\partial T} = \frac{1}{R13} \cdot \left\{ \frac{\partial VD11}{\partial T} + \frac{k}{q} \cdot \frac{R12}{R11} \cdot \ln\left( \frac{I012 \cdot \frac{W12}{L12}}{I011 \cdot \frac{W11}{L11}} \right) \right\} \tag{8}$$

Typically, the temperature dependences of the thermal voltage Vt and the forward voltage of the PN junction diode at an absolute temperature T=300 [K] (=27 degrees centigrade) are given as follows.

$$\frac{\partial VD}{\partial T} \approx -2 \quad [\text{mV/K}] \tag{9}$$

$$\frac{k}{q} \approx \frac{1.38 \cdot 10^{-23}}{1.60 \cdot 10^{-19}} \approx 0.086 \quad [\text{mV/K}] \tag{10}$$

Therefore, a condition required for achieving the output current I4 having substantially no temperature dependence can be expressed by the following equation (11), which is obtained by substituting the equations (9) and (10) into the equation (8).

$$0 = \frac{1}{R13} \left\{ -2 \cdot 10^{-3} + 0.086 \cdot 10^{-3} \cdot \frac{R12}{R11} \cdot \ln\left( \frac{I012 \cdot \frac{W12}{L12}}{I011 \cdot \frac{W11}{L11}} \right) \right\} \tag{11}$$

$$\therefore \frac{R12}{R11} \cdot \ln\left( \frac{I012 \cdot \frac{W12}{L12}}{I011 \cdot \frac{W11}{L11}} \right) \approx 23.26$$

However, the PN junction diode is an essential component in the reference current generating circuit X1 shown in FIG. 1. Meanwhile, a CMOSFET process is currently the most popular LSI process. The PN junction diode is not required for constituting only digital circuit. Moreover, the PN junction diode is not needed except for a partial exception (e.g. band gap reference circuit) in order to constituting an analog circuit by the CMOSFET process. In these circumstances, the PN junction diode is an additional element. In order to implement such an additional element, a time and costs of development increase because particular process for fabricating the additional element is needed. Moreover, the particular processes cause increase in costs of manufacturing a product. That is, the reference current generating circuit that uses the PN junction diode causes increase in a time and costs.

SUMMARY

In an aspect of the present invention, a reference current generating circuit is provided. The reference current generating circuit has a first current mirror circuit, a second current mirror circuit, a first output terminal and a second output terminal. The first current mirror circuit has: a first transistor of a first polarity being an input-side transistor of the first current mirror circuit; and a first resistor connected between a gate of the first transistor and a power supply terminal. The second current mirror circuit has a second transistor of a second polarity complementary to the first polarity, the second transistor being an input-side transistor of the second current mirror circuit. An output node of the first current mirror circuit is connected to an input node of the second current mirror circuit, and an input node of the first current mirror circuit is connected to an output node of the second current mirror circuit. A control voltage applied to the gate of the first transistor is output from the first output terminal. A control voltage applied to a gate of the second transistor is output from the second output terminal.

According to the present invention, the reference current generating circuit whose circuit current has substantially no temperature dependence can be achieved without using a PN junction diode.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

(First Embodiment)

Figure 1:
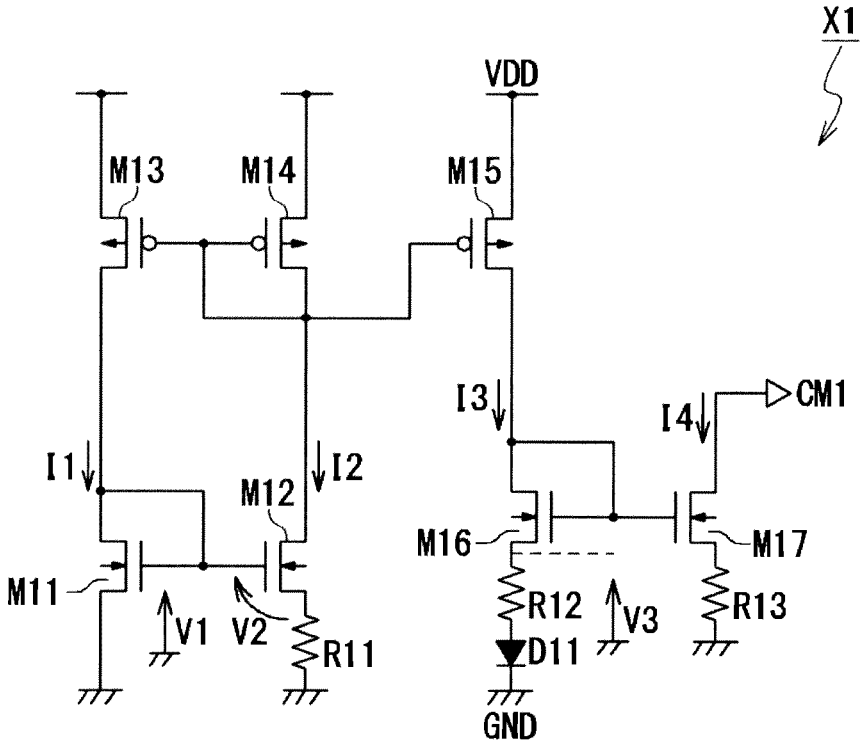
PRIOR ART Fig. 1
FIG. 1 is a circuit diagram showing a configuration of a reference current generating circuit according to a related technique.
Figure 2:
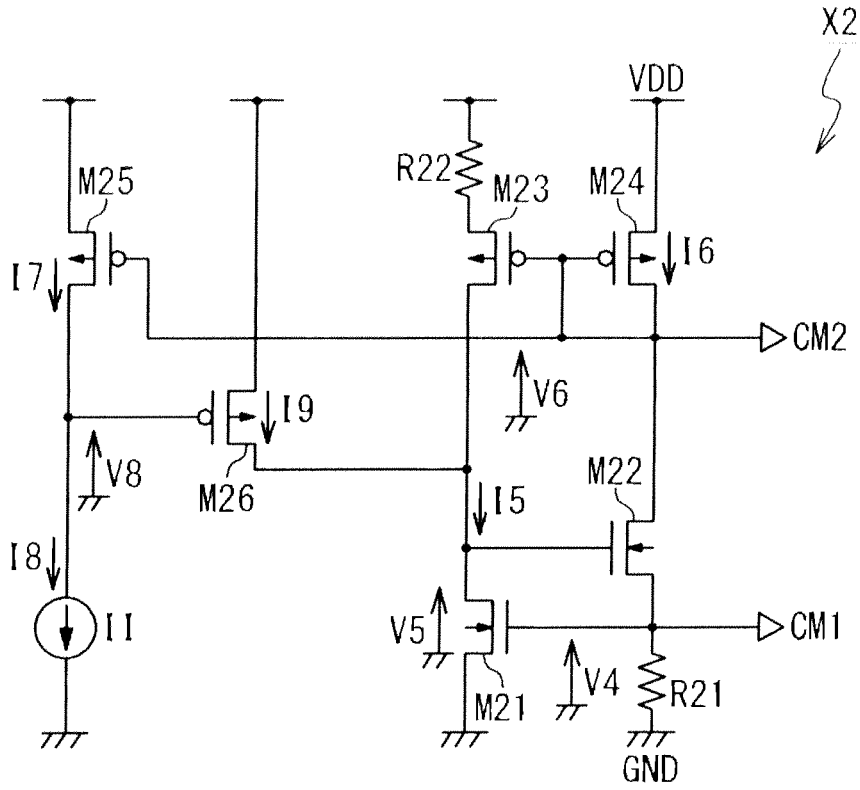
FIG. 2 is a circuit diagram showing a configuration of a reference current generating circuit according to a first embodiment of the present invention.

FIG. 2 is a circuit diagram showing a configuration of a reference current generating circuit X2 according to a first embodiment of the present invention. The reference current generating circuit X2 according to the first embodiment has: N-channel MOS transistors M21 and M22; P-channel MOS transistors M23 to M26; resistors R21 and R22; a constant current source II; output nodes (output terminals) CM1 and CM2; and power supply terminals VDD and GND. All the MOS transistors are enhancement (normally off) type.

The transistor M25 and the constant current source II are serially connected between the power supply terminals VDD and GND. A connection node between a drain of the transistor M25 and the constant current source II is connected to a gate of the transistor M26. A source of the transistor M26 is connected to the power supply terminal VDD, and a drain thereof is connected to a drain of the transistor M21. The drain of the transistor M21 is further connected to a gate of the transistor M22 and a drain of the transistor M23. A source of the transistor M21 is connected to the power supply terminal GND. A source of the transistor M23 is connected to the power supply terminal VDD through the resistor R22. Gates of the transistors M23, M24 and M25 are commonly connected to drains of the transistors M24 and M22, namely, the output node CM2. A gate of the transistor M21 is connected to a connection node between a source of the transistor M22 and one end of the resistor R21, i.e., an output node CM1. The other end of the resistor R21 is connected to the power supply terminal GND. A source of the transistor M24 is connected to the power supply terminal VDD. It should be noted that description of a connection to a back gate of the MOS transistor is omitted in FIG. 2. The back gate may be connected to a source of the MOS transistor. Alternatively, a back gate of the N-channel MOS transistor may be connected to the power supply terminal GND, and a back gate of the P-channel MOS transistor may be connected to the power supply terminal VDD. A control voltage applied to the gate of the transistor M21 is output from the output node (output terminal) CM1. A control voltage applied to the gate of the transistor M24 is output from the output node (output terminal) CM2.

The transistor M21 constitutes an input-side of an N-channel MOS transistor current mirror circuit, and the transistor M24 constitutes an input-side of a P-channel MOS transistor current mirror circuit. When external MOS transistors are connected to the output nodes (output terminals) CM1 and CM2 of the reference current generating circuit X2 as to be output-sides of the respective current mirror circuits, an output current can be obtained. Specifically, a gate of an N-channel MOS transistor is connected to the output node CM1, and a gate of a P-channel MOS transistor is connected to the output node CM2. When a resistor is connected to a drain of the output-side MOS transistor, a voltage output can be obtained. The output voltage value is determined by multiplying the resistance value by a drain current value of the output-side MOS transistor.

An operation of the reference current generating circuit X2 will be described below. In the reference current generating circuit X2, the transistors M21 and M22 constitute a threshold reference current mirror circuit (first current mirror circuit). The transistors M24 and M23 constitute a Widlar current mirror circuit (second current mirror circuit). Each of the current mirror circuits has non-linear characteristics. An output node of the threshold reference current mirror circuit is connected to an input node of the Widlar current mirror circuit, and an input node of the threshold reference current mirror circuit is connected to an output node of the Widlar current mirror circuit. Consequently, the circuits as a whole constitutes a self-feedback circuit. A current flowing in the circuits as a whole is stabilized and converged to either zero or a specific value that is determined by respective circuit constants of the both current mirror circuits with which respective input/output current values match with each other.

Let us calculate non-zero stable current values with regard to a drain current I5 of the transistors M21 and M23 and drain currents I6 of the transistors M22 and M24. A section including the transistors M25 and M26 and the current source II capable of supplying a constant current I8 is served as a start-up circuit that starts up the other circuit section at power ON. A detailed operation of the start-up circuit will be described later. When the other circuit section is operating normally, the start-up circuit needs to stop operating, namely, a drain current I9 of the transistor M26 needs to become zero. Here, let us consider a case where the drain current I9 is zero.

Let μx denote electron mobility (in a case of N-channel MOS transistor) or hole mobility (in a case of P-channel MOS transistor) of a MOS transistor Mx (x is an element number). Let Cox, Wx, Lx and Vthx respectively denote a gate oxide film capacitance per unit area, a gate width, a gate length and a threshold voltage of the MOS transistor Mx. For simplifying of circuit analysis, let us consider a case where each the transistors M21 to M24 operates in a saturation region, and influences by the body effect and the early effect are negligible. In this case, the following equations (12), (13) and (14) can be obtained with respect to the reference current generating circuit X2. Here, βx=μx×Cox, and a voltage V6 is a gate voltage of the transistors M23 and M24.

$$I5 = \frac{\beta 21}{2} \cdot \frac{W21}{L21} \cdot (I6 \cdot R21 - Vth21)^2 \tag{12}$$

$$I6 = \frac{\beta 24}{2} \cdot \frac{W24}{L24} \cdot (VDD - V6 - Vth24)^2 \tag{13}$$

$$I5 = \frac{\beta 23}{2} \cdot \frac{W23}{L23} \cdot (VDD - V6 - I5 \cdot R22 - Vth23)^2 \tag{14}$$

Considering a relationship I6×R21−Vth21>0, the following equation (15) can be obtained from the equation (12).

$$\sqrt{\frac{I5}{\frac{\beta 21}{2} \cdot \frac{W21}{L21}}} = I6 \cdot R21 - Vth21 \tag{15}$$

$$\therefore I6 = \frac{Vth21 + \sqrt{\frac{I5}{\frac{\beta 21}{2} \cdot \frac{W21}{L21}}}}{R21}$$

Furthermore, the following equations (13-2) and (14-2) can be obtained from the equations (13) and (14), respectively.

$$VDD - V6 - Vth24 = \sqrt{\frac{I6}{\frac{\beta 24}{2} \cdot \frac{W24}{L24}}} \tag{13-2}$$

$$VDD - V6 - I5 \cdot R22 - Vth23 = \sqrt{\frac{I5}{\frac{\beta 23}{2} \cdot \frac{W23}{L23}}} \tag{14-2}$$

Here, the transistors M23 and M24 are the same type, and all constants except for W23=P×W24 (P is a constant) are same in the transistors M23 and M24. That is, the following equation (16) can be obtained.

$$\left.\begin{aligned} \beta 23 &= \beta 24 \\ Vth23 &= Vth24 \\ W23 &= P \cdot W24 \\ L23 &= L24 \end{aligned}\right\} \tag{16}$$

Then, the following equation (17) can be obtained from the equations (13-2), (14-2) and (16).

$$I5 \cdot R22 = \sqrt{\frac{I6}{\frac{\beta 24}{2} \cdot \frac{W24}{L24}}} - \sqrt{\frac{I5}{\frac{\beta 24}{2} \cdot P \cdot \frac{W24}{L24}}} \tag{17}$$

$$R22 \cdot I5 = -\frac{1}{\sqrt{\frac{\beta 24}{2} \cdot P \cdot \frac{W24}{L24}}} \cdot \sqrt{I5} + \frac{1}{\sqrt{\frac{\beta 24}{2} \cdot \frac{W24}{L24}}} \cdot \sqrt{I6}$$

$$\therefore I5 = \frac{1}{R22 \cdot \sqrt{\frac{\beta 24}{2} \cdot \frac{W24}{L24}}} \cdot \left(\sqrt{I6} - \sqrt{\frac{I5}{P}}\right)$$

Further, the following equation (18) can be obtained from the equation (17).

$$\sqrt{I5} = \frac{-\frac{1}{\sqrt{\frac{\beta 24}{2} \cdot P \cdot \frac{W24}{L24}}} + \sqrt{\frac{1}{\frac{\beta 24}{2} \cdot P \cdot \frac{W24}{L24}} + 4 \cdot R22 \cdot \sqrt{\frac{I6}{\frac{\beta 24}{2} \cdot \frac{W24}{L24}}}}}{2 \cdot R22} \tag{18}$$

Based on the foregoing equations (15) and (18), a solution of the drain currents I5 and I6 can be obtained.

Next, temperature dependence of the drain currents I5 and I6 in the case of the reference current generating circuit X2 is considered. For simplifying of circuit analysis, let us consider a case where resistance values of the resistors R21 to R22 have no temperature dependence. In this case, only Vth21, β21 and β24 among variables included in the equations (15) and (17) have temperature dependence under a practical condition. By differentiate both sides of the equations (15) and (17) with respect to absolute temperature T, the following equations (15-2) and (17-2) can be respectively obtained.

$$\frac{\partial I6}{\partial T} = \frac{1}{R21} \cdot \left\{ \frac{\partial Vth21}{\partial T} + \sqrt{\frac{I5}{\frac{1}{2} \cdot \frac{W21}{L21}}} \cdot \left(-\frac{1}{2}\right) \cdot \beta 21^{-\frac{3}{2}} \cdot \frac{\partial \beta 21}{\partial T} + \frac{1}{\sqrt{\frac{\beta 21}{2} \cdot \frac{W21}{L21}}} \cdot \frac{1}{2} \cdot I3^{-\frac{1}{2}} \cdot \frac{\partial I5}{\partial T} \right\} \tag{15-2}$$

$$\therefore \frac{\partial I6}{\partial T} = \frac{1}{2 \cdot R21} \cdot \left\{ 2 \cdot \frac{\partial Vth21}{\partial T} - \sqrt{\frac{I5}{\frac{\beta 21}{2} \cdot \frac{W21}{L21}}} \cdot \frac{1}{\beta 21} \cdot \frac{\partial \beta 21}{\partial T} + \sqrt{\frac{I5}{\frac{\beta 21}{2} \cdot \frac{W21}{L21}}} \cdot \frac{1}{I5} \cdot \frac{\partial I5}{\partial T} \right\}$$

-continued $$\frac{\partial I5}{\partial T} = \frac{1}{R22} \cdot \left\{ \frac{\sqrt{I6} - \sqrt{\frac{I5}{P}}}{\sqrt{\frac{1}{2} \cdot \frac{W24}{L24}}} \cdot \left(-\frac{1}{2}\right) \cdot \beta 24^{-\frac{3}{2}} \cdot \frac{\partial \beta 24}{\partial T} + \frac{1}{\sqrt{\frac{\beta 24}{2} \cdot \frac{W24}{L24}}} \cdot \frac{1}{2} \cdot \left(I6^{-\frac{1}{2}} \cdot \frac{\partial I6}{\partial T} - \frac{1}{\sqrt{P}} \cdot I5^{-\frac{1}{2}} \cdot \frac{\partial I5}{\partial T}\right) \right\} \tag{17-2}$$

$$= \frac{1}{R22} \cdot \left\{ -\frac{1}{2} \cdot \frac{\sqrt{I6} - \sqrt{\frac{I5}{P}}}{\sqrt{\frac{\beta 24}{2} \cdot \frac{W24}{L24}}} \cdot \frac{1}{\beta 24} \cdot \frac{\partial \beta 24}{\partial T} + \frac{1}{2} \cdot \frac{1}{\sqrt{\frac{\beta 24}{2} \cdot \frac{W24}{L24}}} \cdot \left(\frac{\sqrt{I6}}{I6} \cdot \frac{\partial I6}{\partial T} - \frac{1}{\sqrt{P}} \cdot \frac{\sqrt{I5}}{I5} \cdot \frac{\partial I5}{\partial T}\right) \right\}$$

$$\therefore \frac{\partial I5}{\partial T} = \frac{1}{2 \cdot R22} \sqrt{\frac{I6}{\frac{\beta 24}{2} \cdot \frac{W24}{L24}}} \cdot \left\{ -\left(1 - \sqrt{\frac{I5}{P \cdot I6}}\right) \cdot \frac{1}{\beta 24} \cdot \frac{\partial \beta 24}{\partial T} + \frac{1}{I6} \cdot \frac{\partial I6}{\partial T} - \sqrt{\frac{I5}{P \cdot 15}} \cdot \frac{1}{I5} \cdot \frac{\partial 15}{\partial T} \right\}$$

By substituting the equation (15-2) into the equation (17-2), we obtain the following equation (19).

$$\frac{\partial I5}{\partial T} = \frac{1}{2 \cdot R22} \cdot \sqrt{\frac{I6}{\frac{\beta 24}{2} \cdot \frac{W24}{L24}}} \cdot \left\{ -\left(1 - \sqrt{\frac{I5}{P \cdot I6}}\right) \cdot \frac{1}{\beta 24} \cdot \frac{\partial \beta 24}{\partial T} - \sqrt{\frac{I5}{P \cdot 15}} \cdot \frac{1}{I5} \cdot \frac{\partial I5}{\partial T} \right\} + \frac{1}{2 \cdot R22} \cdot \sqrt{\frac{I6}{\frac{\beta 24}{2} \cdot \frac{W24}{L24}}} \cdot \frac{1}{I6} \cdot \frac{1}{2 \cdot R21} \cdot \left( 2 \cdot \frac{\partial Vth21}{\partial T} - \sqrt{\frac{I5}{\frac{\beta 21}{2} \cdot \frac{W21}{L21}}} \cdot \frac{1}{\beta 21} \cdot \frac{\partial \beta 21}{\partial T} + \sqrt{\frac{I5}{\frac{\beta 21}{2} \cdot \frac{W21}{L21}}} \cdot \frac{1}{I5} \cdot \frac{\partial T5}{\partial T} \right) \tag{19}$$

$$\therefore \left\{ 1 + \frac{1}{2 \cdot I5 \cdot R22} \cdot \sqrt{\frac{I6}{\frac{\beta 24}{2} \cdot \frac{W24}{L24}}} \cdot \left( \sqrt{\frac{I5}{P \cdot I6}} - \frac{1}{2 \cdot I6 \cdot R21} \cdot \sqrt{\frac{I5}{\frac{\beta 21}{2} \cdot \frac{W21}{L21}}} \right) \right\} \cdot \frac{\partial I5}{\partial T} =$$

$$\frac{1}{2 \cdot R22} \cdot \sqrt{\frac{I6}{\frac{\beta 24}{2} \cdot \frac{W24}{L24}}} \cdot \left\{ -\left(1 - \sqrt{\frac{I5}{P \cdot I6}}\right) \cdot \frac{1}{\beta 24} \cdot \frac{\partial \beta 24}{\partial T} + \right.$$

-continued $$\frac{1}{2\cdot I6\cdot R21}\cdot\left(2\cdot\frac{\partial Vth21}{\partial T}-\sqrt{\frac{I5}{\frac{\beta21}{2}\cdot\frac{W21}{L21}}}\cdot\frac{1}{\beta21}\cdot\frac{\partial\beta21}{\partial T}\right)\Bigg\}$$

A condition required for achieving the drain current I5 having no temperature dependence is ∂I5/∂T=0. Considering the equation (19), the condition can be expressed by the following equation (20).

$$-\left(1-\sqrt{\frac{I5}{P\cdot I6}}\right)\cdot\frac{1}{\beta24}\cdot\frac{\partial\beta24}{\partial T}+\frac{1}{2\cdot I6\cdot R21}\cdot\left(2\cdot\frac{\partial Vth21}{\partial T}-\sqrt{\frac{I5}{\frac{\beta21}{2}\cdot\frac{W21}{L21}}}\cdot\frac{1}{\beta21}\cdot\frac{\partial\beta21}{\partial T}\right)=0 \tag{20}$$

$$-I6\cdot R21\cdot\left(1-\sqrt{\frac{I5}{P\cdot I6}}\right)\cdot\frac{1}{\beta24}\cdot\frac{\partial\beta24}{\partial T}+\frac{\partial Vth21}{\partial T}-\frac{1}{2}\cdot\sqrt{\frac{I5}{\frac{\beta21}{2}\cdot\frac{W21}{L21}}}\cdot\frac{1}{\beta21}\cdot\frac{\partial\beta21}{\partial T}=0$$

$$\therefore\frac{\partial Vth21}{\partial T}=I6\cdot R21\cdot\left(1-\sqrt{\frac{I5}{P\cdot I6}}\right)\cdot\frac{1}{\beta24}\cdot\frac{\partial\beta24}{\partial T}+\frac{1}{2}\cdot\sqrt{\frac{I5}{\frac{\beta21}{2}\cdot\frac{W21}{L21}}}\cdot\frac{1}{\beta21}\cdot\frac{\partial\beta21}{\partial T}$$

In general, the gate oxide film capacitance Co per unit area of a MOS transistor has no temperature dependence. Therefore, the temperature characteristics of β are the same as the temperature characteristics of μ. The temperature dependences of the threshold voltage Vth and the mobility μ of the MOS transistor at an absolute temperature T=300 [K] are given as follow. Regarding the threshold voltage Vth, the following equation (21) can be obtained.

$$\frac{\partial Vth}{\partial T}\approx-2\ [\text{mV/K}] \tag{21}$$

Regarding the electron mobility μ, when its value at an absolute temperature R [K] is μR, the following equation can be obtained.

$$\mu=\mu R\cdot\left(\frac{R}{T}\right)^{1.5}$$

When R=300 [K] is used as a base, the following equation (22) can be obtained.

$$\mu=\mu300\cdot\left(\frac{300}{T}\right)^{1.5} \tag{22}$$

$$\left.\frac{\partial\mu}{\partial T}\right|_{T=300[K]}=\mu300\cdot300^{1.5}\cdot(-1.5)\cdot T^{-2.5}|_{T=300[K]}=\mu300\cdot300^{1.5}\cdot(-1.5)\cdot300^{2.5}$$

-continued $$\therefore\frac{1}{\mu300}\cdot\left.\frac{\partial\mu}{\partial T}\right|_{T=300[K]}=-0.5\cdot10^{-2}[/K]|$$

$$\frac{1}{\beta}\cdot\frac{\partial\beta}{\partial T}=\frac{1}{Co\chi\cdot\mu}\cdot Co\chi\cdot\frac{\partial\mu}{\partial T}=\frac{1}{\mu}\cdot\frac{\partial\mu}{\partial T}\approx-0.5\cdot10^{-2}[/K]$$

By substituting the equation (21) into the equation (20), we obtain the following equation (23).

$$-2\cdot10^{-3}=\left\{I4\cdot R21\cdot\left(1-\sqrt{\frac{I5}{P\cdot I6}}\right)+\frac{1}{2}\cdot\sqrt{\frac{I5}{\frac{\beta21}{2}\cdot\frac{W21}{L21}}}\right\}\cdot(-0.5\cdot10^{-2}) \tag{23}$$

$$\therefore I6\cdot R21\cdot\left(1-\sqrt{\frac{I5}{P\cdot I6}}\right)+\frac{1}{2}\cdot\sqrt{\frac{I5}{\frac{\beta21}{2}\cdot\frac{W21}{L21}}}=0.4$$

For example, circuit constant values expressed by the following equation (24) are possible in the equation (23). Here, VGS21 denotes a gate-source voltage (=V4) of the transistor M21. These circuit constant values are realistic values for use in an analog signal processing circuit fabricated on an LSI.

$$\left.\begin{aligned}&R21=0.75\ [\text{M}\Omega]\\&I5=1.7\ [\mu\text{A}]\\&I6=1.0\ [\mu\text{A}]\\&P=6\\&\sqrt{\frac{I5}{\frac{\beta21}{2}\cdot\frac{W21}{L21}}}=VGS21-Vth21=100\ [\text{mV}]\end{aligned}\right\} \tag{24}$$

Next, an operation of the section including the transistors M25 and M26 and the constant current source II in the reference current generating circuit X2 will be described below. This section is served as a start-up circuit that starts up the other circuit section at power ON. Let us consider a status immediately after the reference current generating circuit X2 is powered ON. Potential of the whole electronic circuit have been all zero before the power ON. Since a gate-source voltage of each of the transistors M21 to M24 is zero, the transistors M21 to M24 are in the OFF states, namely, the drain currents I5 and I6 are zero. If this state is maintained, the circuit does not operate even when the power supply voltage is increased enough to operate the circuit. This state corresponds to the above-mentioned state where a current flowing in the whole circuit might be stabilized and converged to zero.

If the circuit does not start operating, it is not usable. In order to start up the circuit, the reference current generating circuit X2 according to the present embodiment is provided with the start-up circuit having the transistors M25 and M26 and the constant current source II. When the transistors M21 to M24 all are turned OFF, the transistor M25 that constitutes a current mirror circuit together with the transistor M24 also is turned OFF, and thus a drain current I7 of the transistor M25 does not flow. When the constant current source II supplies a current, a voltage V8 of a connection node between the drain of the transistor M25 and the constant current source II becomes closer to zero. Thus, a gate-source voltage of the transistor M26 becomes closer to −VDD and the transistor M26 is turned ON. Therefore, the drain current I9 of the transistor M26 flows.

When the drain current I9 flows, a drain voltage V5 of the transistor M21 is increased and thus the transistor M22 is turned ON. Since the transistor M24 operates as a MOS diode, the drain current I6 flows when the transistor M22 is turned ON. Then, the drain current flows also on the side of the transistor M23 that constitutes the Widlar current mirror circuit together with the transistor M24. Meanwhile, when the drain current I6 flows, a gate voltage V4 of the transistor M21 is increased enough to turn ON the transistor M21, and thus the drain current I5 of the transistor M21 flows. In this manner, the start-up circuit operates for activating the transistors M21 to M24.

If the drain current I9 of the transistor M26 continues to flow after the circuit is started up, the current I9 becomes a disturbance factor with respect to the circuit having the transistors M21 to M24, which causes instable operation and characteristics. In order to prevent this problem, circuit constants are designed such that the drain current I7 of the transistor M25 becomes larger than the current I8 of the constant current source II after the circuit is started up. In this case, the voltage V8 of the connection node is increased near the power supply voltage VDD. Then, the gate-source voltage of the transistor M26 becomes closer to zero, and thus the transistor M26 is turned OFF. Therefore, the drain current I9 becomes zero.

It should be noted that a circuit configuration of the reference current generating circuit according to the first embodiment of the present invention is not limited to that shown in FIG. 2. For example, the N-channel transistor and the P-channel transistor in the reference current generating circuit X2 are respectively changed to a P-channel transistor and an N-channel transistor, a direction of the current of the constant current source II is reversed, and the power supply terminal VDD and the power supply terminal GND are respectively changed to a power supply terminal GND and a power supply terminal VDD. Even in this case, the same operation as in the case of the reference current generating circuit X2 can be achieved.

According to the reference current generating circuit X2 of the present embodiment, temperature characteristics of the electron/hole mobility of the MOS transistor are used for giving a positive temperature coefficient to the current generated in the circuit while temperature characteristics of the threshold voltage of the MOS transistor are used for giving a negative temperature coefficient to the current generated in the circuit. Both paths are combined to constitute the self-feedback circuit, and thereby the positive temperature coefficient and the negative temperature coefficient balance with each other. As a result, the temperature dependence of the circuit current becomes substantially zero in the circuit consisting of the MOS transistors and the resistors.

(Second Embodiment)

Figure 3:
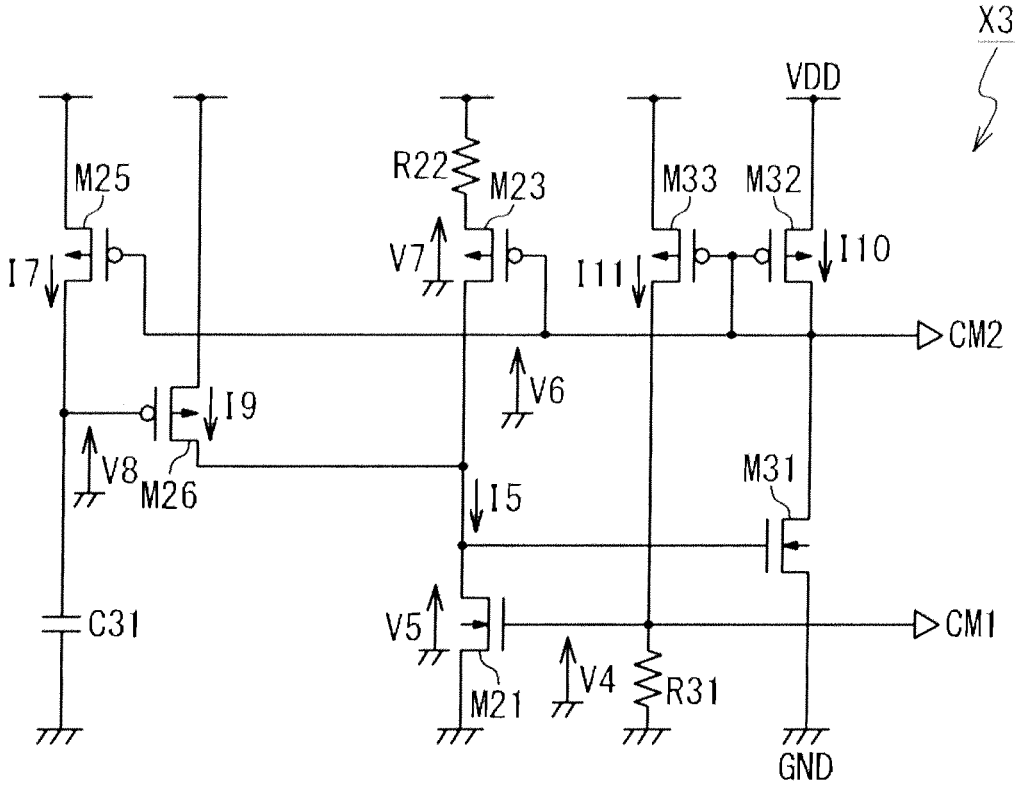
FIG. 3 is a circuit diagram showing a configuration of a reference current generating circuit according to a second embodiment of the present invention.

FIG. 3 is a circuit diagram showing a configuration of a reference current generating circuit X3 according to a second embodiment of the present invention. In the case of the reference current generating circuit X3, the transistors M22 and M24, the resistor R21 and the constant current source II in the reference current generating circuit X2 according to the first embodiment are replaced with transistors M31 to M33, a resistor R31 and a capacitor C31, respectively. The other components are the same as in the case of the first embodiment. In the reference current generating circuit X3, the transistor M31 is an N-channel MOS transistor, and the transistor M32 and M33 each is a P-channel MOS transistor. All the MOS transistors are enhancement (normally off) type.

The transistor M21 is an input-side transistor of the N-channel MOS transistor current mirror circuit, and the transistor M32 is an input-side transistor of a P-channel MOS transistor current mirror circuit. It should be noted that description of a connection to a back gate of the MOS transistor is omitted in FIG. 3. The back gate may be connected to a source of the MOS transistor. Alternatively, a back gate of the N-channel MOS transistor may be connected to the power supply terminal GND, and a back gate of the P-channel MOS transistor may be connected to the power supply terminal VDD.

When external MOS transistors are connected to the output nodes (output terminals) CM1 and CM2 of the reference current generating circuit X3 as to be output-sides of the respective current mirror circuits, an output current can be obtained. Specifically, a gate of an N-channel MOS transistor is connected to the output node CM1, and a gate of a P-channel MOS transistor is connected to the output node CM2. When a resistor is connected to a drain of the output-side MOS transistor, a voltage output can be obtained. The output voltage value is determined by multiplying the resistance value by a drain current value of the output-side MOS transistor.

A section including the transistors M25 and M26 and the capacitor C31 is served as a start-up circuit that starts up the other circuit section at power ON. A detailed operation of the start-up circuit will be described later.

Let μx denote electron mobility (in a case of N-channel MOS transistor) or hole mobility (in a case of P-channel MOS transistor) of a MOS transistor Mx (x is an element number). Let Cox, Wx, Lx and Vthx respectively denote a gate oxide film capacitance per unit area, a gate width, a gate length and a threshold voltage of the MOS transistor Mx. For simplifying of circuit analysis, let us consider a case where each the transistors M21, M23, M31 to M33 operates in a saturation region, and influences by the body effect and the early effect are negligible. In this case, the following equations (25), (26) and (27) can be obtained with respect to the reference current generating circuit X3. Here, βx=μx×Cox. Moreover, I5 is a drain current of the transistor M21, I11 is a drain current of the transistor M33, and a voltage V6 is a gate voltage of the transistors M23, M32 and M33.

$$I5 = \frac{\beta 21}{2} \cdot \frac{W21}{L21} \cdot (I11 \cdot R31 - Vth21)^2 \tag{25}$$

$$I11 = \frac{\beta 33}{2} \cdot \frac{W33}{L33} \cdot (VDD - V6 - Vth33)^2 \tag{26}$$

$$I5 = \frac{\beta 23}{2} \cdot \frac{W23}{L23} \cdot (VDD - V6 - I5 \cdot R22 - Vth23)^2 \tag{27}$$

Considering a relationship I11×R31−Vth21>0, the following equation (28) can be obtained from the equation (25).

$$\sqrt{\frac{I5}{\frac{\beta 21}{2} \cdot \frac{W21}{L21}}} = I11 \cdot R31 - Vth21 \tag{28}$$

$$\therefore I11 = \frac{Vth21 + \sqrt{\frac{I5}{\frac{\beta 21}{2} \cdot \frac{W21}{L21}}}}{R31}$$

Furthermore, the following equations (26-2) and (27-2) can be obtained from the equations (26) and (27), respectively.

$$VDD - V6 - Vth33 = \sqrt{\frac{I11}{\frac{\beta 33}{2} \cdot \frac{W33}{L33}}} \tag{26-2}$$

$$VDD - V6 - I5 \cdot R22 - Vth23 = \sqrt{\frac{I5}{\frac{\beta 23}{2} \cdot \frac{W23}{L23}}} \tag{27-2}$$

Here, the transistors M23 and M33 are the same type, and all constants except for W23=R×W33 (R is a constant) are same in the transistors M23 and M33. That is, the following equation (29) can be obtained.

$$\left.\begin{aligned} \beta 33 &= \beta 23 \\ Vth33 &= Vth23 \\ W23 &= R \cdot W33 \\ L33 &= L23 \end{aligned}\right\} \tag{29}$$

Then, the following equation (30) can be obtained from the equations (26-2), (27-2) and (29).

$$I5 \cdot R22 = \sqrt{\frac{I11}{\frac{\beta 33}{2} \cdot \frac{W33}{L33}}} - \sqrt{\frac{I5}{\frac{\beta 33}{2} \cdot P \cdot \frac{W33}{L33}}} \tag{30}$$

$$R22 \cdot I5 = -\frac{1}{\sqrt{\frac{\beta 33}{2} \cdot P \cdot \frac{W33}{L33}}} \cdot \sqrt{I5} + \frac{1}{\sqrt{\frac{\beta 33}{2} \cdot \frac{W33}{L33}}} \cdot \sqrt{I11}$$

$$\therefore I5 = \frac{1}{R22 \cdot \sqrt{\frac{\beta 33}{2} \cdot \frac{W33}{L33}}} \cdot \left(\sqrt{I11} - \sqrt{\frac{I5}{P}}\right)$$

The equations (28) and (30) respectively are the same as the equations (15) and (17) in the first embodiment except that some variable names are different. Therefore, current values of the currents I5 and I11 flowing in the reference current generating circuit X3, principle and design method for setting the temperature dependences of I5 and I11 to zero are the same as in the case of the first embodiment.

The reference current generating circuit X3 is also provided with a start-up circuit including the transistors M25 and M26 and the capacitor C31, in order to normally start up the circuit as in the case of the reference current generating circuit X2. An operation of the start-up circuit will be described below. Let us consider a status immediately after the reference current generating circuit X3 is powered ON. Since a gate-source voltage of each of the transistors M21, M23 and M31 to M33 is zero, these transistors are in the OFF states. That is, the drain current I5 of the transistor M21, a drain current I10 of the transistor M32 and a drain current I11 of the transistor M31 are all zero. Moreover, since no charge is charged in the capacitor C31, a voltage V8 at a connection node between the drain of the transistor M25 and the capacitor C31 also is zero. When the transistors M21, M23, M31 to M33 all are turned OFF, the transistor M25 that constitutes a current mirror circuit together with the transistor M32 also is turned OFF, and thus a drain current I7 of the transistor M25 does not flow. Therefore, the voltage V8 is maintained at zero. Then, a gate-source voltage of the transistor M26 becomes closer to −VDD and the transistor M26 is turned ON. Therefore, the drain current I9 of the transistor M26 flows.

When the drain current I9 flows, a gate voltage V5 of the transistor M31 is increased and thus the transistor M31 is turned ON. Since the transistor M32 operates as a MOS diode, the drain current I10 flows when the transistor M31 is turned ON. Then, the drain current I5 flows through the transistor M23 that constitutes the Widlar current mirror circuit together with the transistor M32. Furthermore, when the drain current I10 flows, the transistor M33 that constitutes the current mirror circuit together with the transistor M32 also is turned ON and thus the drain current I11 flows. Therefore, a gate voltage V4 of the transistor M21 is increased enough to turn ON the transistor M21, and thus the drain current I5 of the transistor M21 flows. In this manner, the circuit section including the transistors M21, M23 and M31 to M33 starts its operation.

After the circuit section starts its operation, the drain current I9 of the transistor M26 needs to stop. When the drain current I7 of the transistor M25 flows after the circuit section starts its operation, the capacitor C31 is charged and thus the voltage V8 is increased near the power supply voltage VDD with time. Then, the gate-source voltage of the transistor M26 becomes closer to zero, and thus the transistor M26 is turned OFF. Therefore, the drain current I9 of the transistor M26 becomes zero.

It should be noted that a circuit configuration of the reference current generating circuit according to the second embodiment of the present invention is not limited to that shown in FIG. 3. For example, the N-channel transistor and the P-channel transistor in the reference current generating circuit X2 are respectively changed to a P-channel transistor and an N-channel transistor, a direction of the current of the constant current source II is reversed, and the power supply terminal VDD and the power supply terminal GND are respectively changed to a power supply terminal GND and a power supply terminal VDD. Even in this case, the same operation as in the case of the reference current generating circuit X3 can be achieved.

The reference current generating circuit X3 is capable of operating normally even in a case of a low power supply voltage. Regarding the circuit consisting of the transistors M21, M23, M31 to M33 and the resistors R31 and R22 that generates the reference current, there are three paths between the power supply terminal VDD and the power supply terminal GND. In this case, voltages required for the respective paths for achieving the normal operation are as follows. Here, let VDSxmin and VGSxmin respectively denote a minimum value of a drain-source volgate and a minimum value of a gate-source voltage of the MOS transistor Mx (x is an element number) in a condition that the circuit operates normally.

<Path R22-M23-M21>

$$I5 \times R22 + VDS23min + VGS31min \tag{31}$$

<Path M33-R31>

$$VDS33min + VGS21min \tag{32}$$

<Path M32-M31>

$$VGS32min + VDS31min \tag{33}$$

In a case where the circuit is operated with the voltages and the currents as indicated by the foregoing equation (24), parameters required for a typical enhancement type MOS transistor fabricated on an LSI are as follows.

$$\left.\begin{aligned} &VGS_{\chi}\min \approx 1.0\ [\mathrm{V}] \\ &VDS_{\chi}\min \approx 100\ [\mathrm{mV}] \\ &I5 \cdot R22 \approx VDS_{\chi}\min/2 = 50\ [\mathrm{mV}] \end{aligned}\right\} \tag{34}$$

In this case, the highest voltage in the equations (31) to (33) is at most 1.2 [V]. Although such margins as change in a junction temperature and manufacturing variability of characteristics of each element must be taken into consideration in a practical circuit design, the reference current generating circuit X3 according to the present embodiment can operate with, for example, VDD=1.5 [V] as the minimum power supply voltage even if the margins are taken into consideration.

Whereas, regarding the circuit section including the transistors M21 to M24 and the resistors R21 and R22 that generates the reference current in the reference current generating circuit X2, there are two paths between the power supply terminal VDD and the power supply terminal GND. In this case, voltages required for the respective paths for achieving the normal operation are as follows.

<Path R22-M23-M21>

$$I5 \times R22 + VDS23\min + VGS22\min + VGS21\min \tag{35}$$

<Path M24-M22-R21>

$$VGS24\min + VDS22\min + VGS21\min \tag{36}$$

When the numerical example indicated by the equation (34) is applied to the equations (35) and (36), the highest voltage is about 2.2 [V]. Moreover, when the margins in the practical circuit are taken into consideration, the minimum power supply voltage required for the reference current generating circuit X2 is, for example, VDD=2.5 [V]. As described above, the reference current generating circuit X3 is advantageous in that it can operate normally even the lower power supply voltage.

(Third Embodiment)

Figure 4:
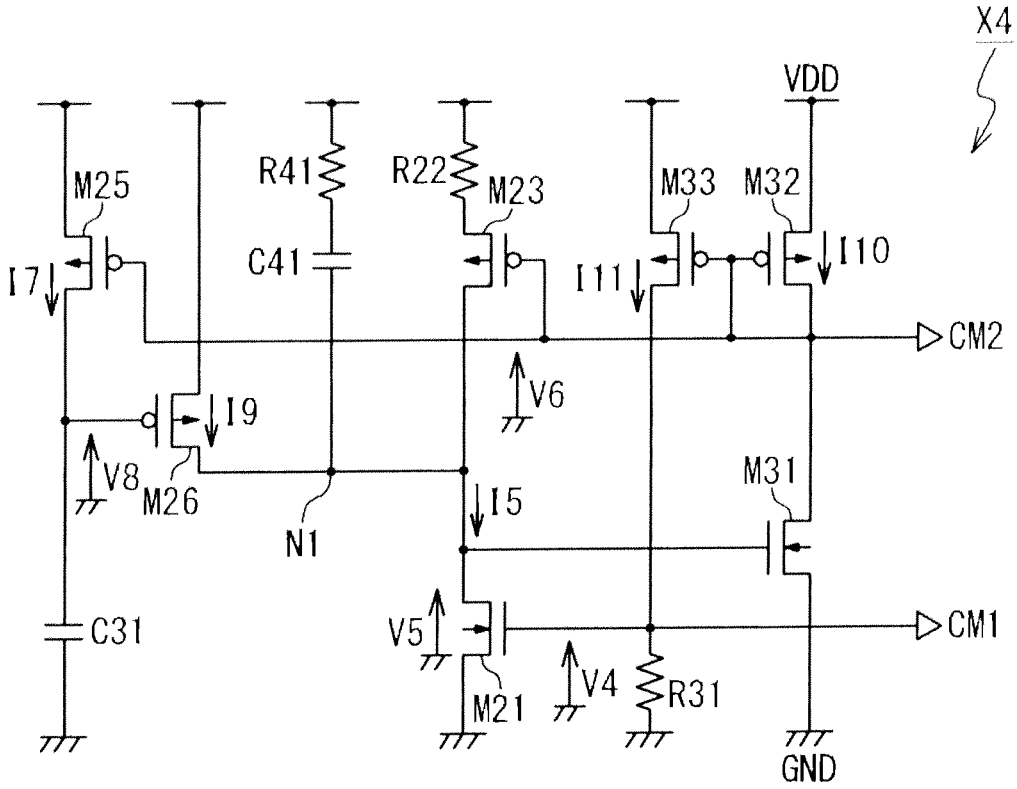
FIG. 4 is a circuit diagram showing a configuration of a reference current generating circuit according to a third embodiment of the present invention.

FIG. 4 is a circuit diagram showing a configuration of a reference current generating circuit X4 according to a third embodiment of the present invention. In the case of the reference current generating circuit X4, a resistor R41 and a capacitor C41 are added to the reference current generating circuit X3 according to the second embodiment, and the other parts are the same as in the case of the second embodiment. The drains of the transistors M21, M23 and M26 are connected to a common node N1.

In the reference current generating circuit X4, respective current outputs from the transistor M21 and the transistor M23 are combined at the node N1. Thus, a voltage V5 that is generated depending on a parallel resistance of internal resistors (drain resistors) of the transistor M21 and the transistor M23 is applied to the gate of the transistor M31. As a result, a negative feedback circuit is constituted in the circuit as a whole. However, in a typical MOS transistor, an output resistance of the drain is high and a parasitic capacitance thereof is small. The node N1 is a position where a phase of a feedback signal is delayed greatly due to the high resistance and small capacitance, particularly in a region of high frequency. When the phase of the feedback signal is much delayed, the feedback path in the circuit as a whole may become a positive feedback path under a specific frequency. This causes oscillation of the circuit at the specific frequency. When the circuit oscillates, an internal current becomes unstable, resulting in a problem that the reference current generating circuit does not operate normally.

In order to prevent the oscillation of the circuit, the reference current generating circuit X4 is provided with a phase compensation circuit that includes the resistor R41 and the capacitor C41. The phase compensation circuit can reduce gain at a higher frequency and/or progress the phase with respect to a node to which the phase compensation circuit is connected. The phase compensation circuit in which the resistor R41 and the capacitor C41 are connected in series can achieve the both operations. It should be noted that the configuration of the phase compensation circuit is not limited to that shown in FIG. 4. The connection positions of the resistor R41 and the capacitor C41 in the reference current generating circuit X4 may be interchanged. The resistor R41 may be omitted and only the capacitor C41 may be used. The phase compensation circuit may be connected to the power supply terminal GND instead of the power supply terminal VDD in the reference current generating circuit X4. However, considering the circuit start-up for sure at power ON, it is preferable that the phase compensation is connected to the power supply terminal VDD. Since no charge is charged in the capacitor C41 at power ON, the capacitor C41 connected to the power supply terminal VDD side can act so as to increase the voltage V5 up to the power supply terminal VDD, which can achieve the same effect as in the case of the start-up circuit described in the second embodiment.

By using the reference current generating circuit according to the above-described embodiments of the present invention, it is possible to generate a stable reference current having substantially no temperature dependence with an economic configuration using the enhancement type MOS transistor and the resistor.

It is apparent that the present invention is not limited to the above embodiments and may be modified and changed without departing from the scope and spirit of the invention.

What is claimed is:

1. A reference current generating circuit comprising:

a first current mirror circuit comprising:

a first transistor of a first polarity being an input-side transistor of said first current mirror circuit; and a first resistor connected between a gate of said first transistor and a power supply terminal;

a second current mirror circuit comprising a second transistor of a second polarity complementary to said first polarity, said second transistor being an input-side transistor of said second current mirror circuit;

a first output terminal; and a second output terminal, wherein an output node of said first current mirror circuit is connected to an input node of said second current mirror circuit, an input node of said first current mirror circuit is connected to an output node of said second current mirror circuit, a control voltage applied to the gate of said first transistor is output from said first output terminal, and a control voltage applied to a gate of said second transistor is output from said second output terminal, wherein said first current mirror circuit further comprises a third transistor of said first polarity being an output-side transistor of said first current mirror circuit, wherein a gate of said third transistor is connected to a drain of said first transistor, and a drain of said third transistor is connected to said output node of said first current mirror circuit, wherein said second current mirror circuit further comprises a fourth transistor of said second polarity being an output-side transistor of said second current mirror circuit, wherein a gate of said fourth transistor is connected to a drain of said second transistor, and a drain of said fourth transistor is connected to said output node of said second current mirror circuit, wherein said second current mirror circuit further comprises a second resistor connected between a source of said fourth transistor and another power supply terminal.

2. The reference current generating circuit according to claim 1, wherein said first resistor is connected to a source of said third transistor, and said control voltage applied to the gate of said first transistor depends on a current flowing through said third transistor.

3. The reference current generating circuit according to claim 1, further comprising:

a start-up circuit configured to supply a current to said input node of said first current mirror circuit at power ON and to stop supplying the current after said first current mirror circuit starts operating.

4. The reference current generating circuit according to claim 3, wherein said start-up circuit comprises:

a sixth transistor; and a seventh transistor, wherein at power ON, said sixth transistor is turned ON to supply the current to said input node of said first current mirror circuit, wherein after said first current mirror circuit starts operating, said seventh transistor turns said sixth transistor OFF.

5. The reference current generating circuit according to claim 4, wherein a source of said sixth transistor is connected to a first power supply terminal, a drain of said sixth transistor is connected to said input node of said first current mirror circuit, a source of said seventh transistor is connected to said first power supply terminal, a drain of said seventh transistor is connected to a gate of said sixth transistor, and a gate of said seventh transistor is connected to said input node of said second current mirror circuit.

6. The reference current generating circuit according to claim 5, wherein said start-up circuit further comprises a first capacitor connected between the gate of said sixth transistor and said power supply terminal, wherein when said first current mirror circuit starts operating, said seventh transistor charges said first capacitor to turn said sixth transistor OFF.

7. The reference current generating circuit according to claim 5, wherein said start-up circuit further comprises a constant current source connected between the gate of said sixth transistor and said power supply terminal, wherein when said first current mirror circuit starts operating, said seventh transistor supplies a current larger than a constant current supplied by said constant current source.

8. A reference current generating circuit comprising:

a first current mirror circuit comprising:

a first transistor of a first polarity being an input-side transistor of said first current mirror circuit; and a first resistor connected between a gate of said first transistor and a power supply terminal;

a second current mirror circuit comprising a second transistor of a second polarity complementary to said first polarity, said second transistor being an input-side transistor of said second current mirror circuit;

a first output terminal; and a second output terminal, wherein an output node of said first current mirror circuit is connected to an input node of said second current mirror circuit, an input node of said first current mirror circuit is connected to an output node of said second current mirror circuit, a control voltage applied to the gate of said first transistor is output from said first output terminal, and a control voltage applied to a gate of said second transistor is output from said second output terminal, wherein said first current mirror circuit further comprises a third transistor of said first polarity being an output-side transistor of said first current mirror circuit, wherein a gate of said third transistor is connected to a drain of said first transistor, and a drain of said third transistor is connected to said output node of said first current mirror circuit, wherein said second current mirror circuit further comprises a fourth transistor of said second polarity being an output-side transistor of said second current mirror circuit, wherein a gate of said fourth transistor is connected to a drain of said second transistor, and a drain of said fourth transistor is connected to said output node of said second current mirror circuit, wherein said second current mirror circuit further comprises a fifth transistor of said second polarity whose gate is connected to the gate of said second transistor, wherein said first resistor is connected to a drain of said fifth transistor, and said control voltage applied to the gate of said first transistor depends on a current flowing through said fifth transistor.

9. A reference current generating circuit comprising:

a first current mirror circuit comprising:

a first transistor of a first polarity being an input-side transistor of said first current mirror circuit; and a first resistor connected between a gate of said first transistor and a power supply terminal;

a second current mirror circuit comprising: a second transistor of a second polarity complementary to said first polarity, said second transistor being an input-side transistor of said second current mirror circuit;

a first output terminal; and a second output terminal, wherein an output node of said first current mirror circuit is connected to an input node of said second current mirror circuit, wherein an input node of said first current mirror circuit is connected to an output node of said second current mirror circuit, wherein a control voltage applied to the gate of said first transistor is output from said first output terminal, wherein a control voltage applied to a gate of said second transistor is output from said second output terminal; and a start-up circuit configured to supply a current to said input node of said first current mirror circuit at power ON and to stop supplying the current after said first current mirror circuit starts operating, wherein said start-up circuit comprises:

a sixth transistor; and a seventh transistor, wherein at power ON, said sixth transistor is turned ON to supply the current to said input node of said first current mirror circuit, wherein after said first current mirror circuit starts operating, said seventh transistor turns said sixth transistor OFF, wherein said start-up circuit further comprises a phase compensation circuit, wherein said phase compensation circuit comprises a third resistor and a second capacitor that are series connected between said power supply terminal and a drain of said sixth transistor.

* * * * *